United States Patent [19]

Hill et al.

[11] Patent Number: 4,676,836

[45] Date of Patent: Jun. 30, 1987

[54] ANIONIC LUBRICANT DISPERSIONS USEFUL IN PAPER COATINGS

[75] Inventors: John A. Hill, Somerville; Gregory J. Flynn, Branchville, both of N.J.

[73] Assignee: Diamond Shamrock Chemicals Company, Dallas, Tex.

[21] Appl. No.: 906,678

[22] Filed: Sep. 11, 1986

Related U.S. Application Data

[63] Continuation of Ser. No. 661,386, Oct. 16, 1984, abandoned.

[51] Int. Cl.[4] ..... C08L 91/00; B32B 21/04

[52] U.S. Cl. ..... 106/243; 106/159; 106/171; 106/211; 106/214; 524/47; 524/52; 428/537.5; 428/537.7

[58] Field of Search ..... 106/243, 159, 171, 211, 106/214; 524/47, 52; 428/537.5, 537.7

[56] References Cited

U.S. PATENT DOCUMENTS

| | | | |
|---|---|---|---|
| 2,425,231 | 8/1947 | Dickerman | 106/214 |
| 2,425,828 | 8/1947 | Retzsch et al. | 106/243 |
| 3,293,057 | 12/1966 | Rumberger | 106/214 |
| 3,357,844 | 12/1967 | Wood et al. | 106/159 |
| 3,649,543 | 3/1972 | Cahn | 252/554 |
| 3,928,707 | 12/1975 | Lauterbach | 106/214 |
| 4,425,452 | 1/1984 | Nakata | 106/214 |

FOREIGN PATENT DOCUMENTS 7327943 3/1974 France .

OTHER PUBLICATIONS

Kearns et al, Paper Trade Journal, Jul. 24, 1967, pp. 40–41.

Kelly, Jr. et al, Tappi, vol. 53, No. 10 (Oct. 1970), pp. 1900–1904.

Encyclopedia of Chemical Technology–Kirk–Othmer, 2nd Ed., (1967), vol. 14, pp. 515–520.

Pulp and Paper–Chemistry & Chemical Technology–Casey, 2nd Ed., (1961), vol. III, pp. 1552; 1579–1581;1592–1594;1597;1646–1647; 1650.

Paper Coating Additives–Tappi Monograph Series No. 25, (1963), pp. 84–85.

Chem. Abst. 70:69419f, Palenik, 18 Apr. 1968.

*Primary Examiner*—Theodore Morris

*Attorney, Agent, or Firm*—Neal T. Levin

[57] ABSTRACT

Aqueous lubricant dispersions having solids content of from about 50% by weight to about 75% by weight contain calcium stearate, dispersing agent, anionic lubricant and urea are characterized by increased solids content.

32 Claims, No Drawings

ANIONIC LUBRICANT DISPERSIONS USEFUL IN PAPER COATINGS

This application is a continuation of application Ser. No. 661,386, filed Oct. 16, 1984, now abandoned.

BACKGROUND OF THE INVENTION

1. Field of the Invention

This invention relates to increased solids lubricant dispersions which are the source of calcium stearate, a lubricant present as a component of paper and paperboard coating compositions.

2. Description of the Prior Art

Calcium stearate, a water insoluble metal soap, is a recognized component of paper coating compositions. It contributes lubricating, leveling and anti-dusting properties to paper coating compositions which contain primarily pigment, adhesive and lubricant in an aqueous system.

Where the lubricant is calcium stearate, a water insoluble soap, it is generally supplied as an aqueous dispersion which can be introduced along with the other components in the preparation of the paper coating. Such dispersion contains at most 50 to 55% by weight solids including calcium stearate and dispersing agent. Attempts to increase calcium stearate content result in formation of a paste. Further, when the calcium stearate dispersion is prepared by the in situ method, at most, 55% by weight solids is obtained.

U.S. Pat. No. 2,425,828—Retzsch et al, Aug. 19, 1947, discloses preparation of dispersions of metal soaps including calcium stearate using polyethylene glycol mono-esters of fatty acids as dispersing agents. In the examples, dispersions of 40% calcium stearate, 10% dispersing agent and 50% water (50% total solids) and disclosed.

French publication No. 73-27943, published Mar. 1, 1974, discloses lubricants for starch base paper coatings which contain a first lubricant such as calcium stearate and a second lubricant such as modified tallow, preferably de-acidified tallow, neutralized tallow and hydrogenated tallow. Less preferred are tallow substituted with lower alkyl groups, particular waxes, polyethylene glycols and saturated fatty alcohols. Moderately preferred are fatty acid esters. Somewhat lesser preferred are polyethylene glycol esters of fatty acids.

Kearns et al, Paper Trade Journal, July 24, 1967 (p. 40 et seq), in Table I refer to a 53% minimum calcium stearate dispersion.

Kelly, Jr. et al in Tappi Vol. 53, No. 10, page 1900 et seq, describe studies of the factors affecting performance of aqueous solutions of polyethylene glycols and their derivatives as lubricants when present in coating formulations.

Copending application Ser. No. 623,471—Hill et al, filed June 22, 1984, describes aqueous lubricant dispersions used in the preparation of paper and paperboard coating compositions. These dispersions have a solids content of about 50% by weight to about 75% by weight comprising calcium stearate, dispersing agent for same, nonionic lubricant and urea.

The art, however, is still seeking improved calcium stearate dispersions of enhanced solids content. The advantages of such are reduced shipping costs since less water is shipped. Further, when added to the coating composition, less water is introduced meaning less energy is required to remove same during the drying operation.

SUMMARY OF THE INVENTION

Aqueous lubricant dispersions for addition to paper and paperboard coating compositions having a solids content of from about 50% by weight of about 75% by weight, preferably from about 55% by weight to about 75% by weight have been prepared.

The solids content of these dispersions comprises (1) calcium stearate, (2) dispersing agent, (3) water soluble anionic lubricant and (4) urea.

Thus, additional lubricant compositions containing enhanced total solids content have been developed. These compositions, despite reduced calcium stearate content, are as effective as lubricants as the present calcium stearate dispersions containing less total solids content but greater calcium stearate content.

It was most unexpected to find that the combination of water soluble anionic lubricant and relatively large amounts of urea together with calcium stearate forms a high solids content product which functions equally to or better than calcium stearate lubricants and which has a workable viscosity.

DESCRIPTION OF THE PREFERRED EMBODIMENTS

Lubricant Dispersion

The lubricant dispersions contain from about 50% by weight to about 75% by weight, preferably from about 55% by weight to about 75% by weight solids, the remaining component being water. The solids content of the dispersion comprises:

| Component | Parts by Weight |
|---|---|
| calcium stearate | 1.00 |
| dispersing agent for calcium stearate | about 0.01 to about 0.10 |
| water soluble anionic lubricant | about 0.05 to about 5.00 |
| urea | about 0.01 to about 1.00 |

Generally speaking, useful viscosities of these lubricant dispersions can range up to about 1,700 cps Brookfield at 100 rpm.

Calcium stearate is a well known article of commerce and its use in dispersions is well known. Any calcium stearate useful in paper coating compositions is useful herein. Depending upon the grade of stearic acid used in its preparation, there will be present other fatty material such as palmitic and oleic acid. Thus, the term calcium stearate covers calcium stearate as well as calcium stearate containing varying amounts of calcium palmitate, calcium oleate and other materials.

The dispersing agents can be those which are known to disperse calcium stearate in water. Useful dispersing agents are those described in U.S. Pat. No. 2,425,828 such as polyethylene glycol monoesters of fatty acids. Generally, the polyethylene glycol should have a molecular weight of 200 or above such as polyethylene glycols having molecular weights of 200, 300 and 400.

The fatty acids which may be esterified by these glycols may be any fatty acid having from 10 to 24 carbon atoms, such as lauric acid, oleic acid and stearic acid, as well as mixtures of acids obtained from natural glycerides such as mustard seed oil, coconut oil and other naturally occurring oils as well as the glycerides themselves.

Specific examples of dispersing agent are the monoesters of the reaction product of polyethylene glycol 400 and mustard seed oil as described in Example I of U.S. Pat. No. 2,425,828 and the reaction product of polyethylene glycol 400 and coconut fatty acids as described in Example II of U.S. Pat. No. 2,425,828.

Other useful dispersing agents include polyoxyethylene adducts of alkylated phenols. Generally, the alkyl group contains from 8 to 16 carbon atoms such as in octyl phenol, nonyl phenol and dodecyl phenol and can be straight or branched chain. The alkylated phenol can be reacted with from about 6 to about 15 moles of ethylene oxide. Examples include octyl phenol reacted with 9 moles of ethylene oxide and dodecyl phenol reacted with 12 moles of ethylene oxide. Also, ethoxylated alcohols such as the adduct of tridecyl alcohol and six moles of ethylene oxide can be used.

The lubricants can be one or a mixture of particular water soluble anionic lubricants. Useful water soluble anionic lubricants are:

(a) sulfated fatty acid esters including ammonium, substituted ammonium and alkali metal sulfates of lower esters of $C_{12}$ to $C_{22}$ fatty acids, such as sulfated butyl oleate, sodium salt, (b) fatty acid soaps including ammonium, substituted ammonium and alkali metal salts of $C_{12}$ to $C_{22}$ saturated and unsaturated fatty acids such as potassium laurate, sodium stearate and lithium oleate, (c) sulfated fatty acids including ammonium, substituted ammonium and alkali metal sulfates of $C_{12}$ to $C_{22}$ fatty acids such as sulfated oleic acid, sodium salt and sulfated castor fatty acids, sodium salt, (d) linear alkyl aryl sulfonates including ammonium, substituted ammonium and alkali metal sulfonates of $C_{10}$ to $C_{14}$ alkyl substituted benzene such as sodium dodecyl benzene sulfonate, (e) ethoxy sulfates including ammonium, substituted ammonium and alkali metal salts of $C_{12}$ to $C_{15}$ ethoxy sulfates containing from about 2 to about 8 moles of ethylene oxide such as the sodium salt of $C_{12}$ to $C_{15}$ ethoxy sulfate containing 3 moles of ethylene oxide, (f) alcohol sulfates including ammonium, substituted ammonium and alkali metal sulfates of $C_{12}$ to $C_{22}$ straight and branched chain alcohols such as tridecyl alcohol sulfate, sodium salt, (g) sulfated castor oil ethoxylates including ammonium, substituted ammonium and alkali metal salts of sulfated castor oil condensed with from about 3 to about 10 moles of ethylene oxide such as sulfated castor oil ethoxylated with 5 moles of ethylene oxide, sodium salt, (h) phosphate esters of alkylphenol ethoxylates including phosphate esters of condensates of $C_8$ to $C_{18}$ alkyl phenols with from about 4 to about 10 moles of ethylene oxide such as the phosphate ester of nonyl phenol condensed with 9 moles of ethylene oxide, (i) sulfated alkyl aryl ethoxylates including ammonium, substituted ammonium and alkali metal sulfates of $C_8$ to $C_{18}$ alkyl phenols condensed with from about 4 to about 10 moles of ethylene oxide such as the ammonium salt of sulfated nonyl phenol condensed with 4 moles of ethylene oxide, (j) alpha olefin sulfonates of the structure $R—CH{=}CHCH_2SO_3X$ where $R=C_{11}$ to $C_{13}$ and X is ammonium, substituted ammonium or alkali metal, such as where $R=C_{11}$ to $C_{13}$ and X is sodium, (k) sulfonated alkyl phenol ethoxylates including ammonium, substituted ammonium and alkali metal sulfonates of $C_1$ to $C_9$ alkyl phenols condensed with from about 4 to about 10 moles of ethylene oxide such as sulfonated octyl phenol condensed with 7 moles of ethylene oxide, sodium salt, (l) bis alkyl sulfosuccinates including ammonium, substituted ammonium and alkali metal salts of bis straight or branched chain $C_4$ to $C_{12}$ alkyl sulfosuccinates such as sodium salt of bis-2-ethylhexyl sulfosuccinate, sodium salt of bis-n-octyl sulfosuccinate, sodium salt of bis-isodecyl sulfosuccinate, sodium salt of bis-hexyl sulfosuccinate, ammonium salt of bis-2-ethylhexyl sulfosuccinate, ammonium salt of bis-n-octyl sulfosuccinate and monoethanolamine salt of bis-2-ethylhexyl sulfosuccinate, and (m) sulfated glycerides, primarily triglycerides, of unsaturated fatty acids including ammonium, substituted ammonium and alkali metal sulfates of the triglycerides of oleic, ricinoleic, linoleic, linolenic and erucic acids. Also useful are sulfated vegetable oils which contain these glycerides in predominant amounts such as the ammonium, substituted ammonium and alkali metal sulfates of peanut oil, rice bran oil, tall oil, mustard seed oil and castor oil.

Where substituted ammonium salts are used, they are derived from mono, di and tri lower alkanolamines such as monoethanolamine, diethanolamine, triethanolamine and mixed isopropanolamines and methyl amines such as methyl and dimethyl amine.

The preparation of these dispersions can be carried out in the following manner. Dry calcium stearate is dispersed in water with a dispersing agent. Generally from about 0.01 to about 0.10 parts by weight of dispersing agent per 1.00 parts by weight calcium stearate is used. Thereafter, anionic lubricant and urea are added to the dispersion in any order or together.

At this point, it can be seen that the starting point of this invention can be, if desired, the conventional calcium stearate dispersions of no more than 55% by weight of solids. They are prepared by reacting stearic acid or fatty acid mixture containing stearic acid with a calcium containing material such as calcium hydroxide in the presence of water and dispersant using thorough mixing. The preparation of these dispersions is well known and the use of same herein is not limited to any particular calcium stearate, or any particular dispersing agent.

To the calcium stearate dispersion, regardless of its source, there is added from about 0.05 part by weight to about 5.00 parts by weight of anionic lubricant per 1.00 part by weight of calcium stearate and urea in amounts of from about 0.01 to about 1.00 part by weight per 1.00 part by weight of calcium stearate in any order or together.

Coating Composition

The coating compositions to which the high solids lubricant dispersions are added are well known and the addition of the high solids lubricant dispersion is not limited to any particular coating composition.

The coating compositions contain in addition to a lubricant both pigment and binder (adhesive), and optionally, solubilizer, all in an aqueous system. Typical pigments are clay (Kaolin), calcium carbonate, satin white, talc, titanium dioxide, zinc oxide and blanc fixe, while typical binders are starch, such as ethylated and oxidized starch, protein such as soya protein and casein, and synthetic resins such as butadiene styrene latex such as a 60/40 styrene/butadiene copolymer and polyvinyl acetate-acrylic copolymer.

Examples of insolubilizer are melamineformaldehyde resin and glyoxal-urea reaction product.

The starch is generally cooked in water, then added to a dispersion of the pigment. Thereafter, the high solids calcium stearate lubricant is introduced. Based on 100 parts by weight pigment, there is used from about 10 to about 25 parts by weight binder and from about 0.5 to about 1.5 parts by weight of lubricant solids. Optionally, there can be used from about 0.4 to about 2.5 parts by weight of insolubilizer.

The solids content of the coating composition can vary from about 30% by weight to about 70% by weight, the remainder being water.

The coating compositions containing the high solids lubricant are applied to paper and paperboard by conventional methods which include the steps of applying the coating compositions to the paper or the paperboard, smoothing, drying and calendering or supercalendaring.

For a fuller understanding of this invention, reference may be made to the following examples. These examples are given merely to illustrate the invention and are not to be construed in a limiting sense.

Examples I through XIII describe the increased solids lubricant dispersions of this invention. All were prepared according to the following general procedure.

A 50% by weight calcium stearate dispersion was placed in a laboratory mixer. Additional water as required was added, followed by addition of urea and anionic lubricant as aqueous solutions. Mixing was carried out until a homogeneous dispersion was formed. Viscosities were determined for the compositions of each example using a Brookfield Viscometer at 100 rpm. Total water content including water introduced with the calcium stearate dispersion and with the anionic lubricant is given.

EXAMPLE I

| Component | Parts by Weight |
|---|---|
| calcium stearate | 30.48 |
| condensate of nonyl phenol + 10 moles ethylene oxide | 1.88 |
| sulfated butyl oleate, sodium salt | 12.88 |
| urea | 19.76 |
| water | 35.00 |

viscosity = 298 cps

EXAMPLE II

| Component | Parts by Weight |
|---|---|
| calcium stearate | 23.45 |
| condensate of nonyl phenol + 10 moles ethylene oxide | 1.45 |
| potassium laurate | 9.90 |
| urea | 15.20 |
| water | 50.00 |

viscosity = 1,700 cps

EXAMPLE III

| Component | Parts by Weight |
|---|---|
| calcium stearate | 31.41 |
| condensate of nonyl phenol + 10 moles ethylene oxide | 1.95 |
| sulfated castor oil, sodium salt | 13.28 |
| urea | 20.36 |
| water | 33.00 |

viscosity = 234 cps

EXAMPLE IV

| Component | Parts by Weight |
|---|---|
| calcium stearate | 28.14 |
| condensate of nonyl phenol + 10 moles ethylene oxide | 1.74 |
| sulfated oleic acid, sodium salt (free carboxylic acid form) | 11.88 |
| urea | 18.24 |
| water | 40.00 |

viscosity = 644 cps

EXAMPLE V

| Component | Parts by Weight |
|---|---|
| calcium stearate | 31.41 |
| condensate of nonyl phenol + 10 moles ethylene oxide | 1.95 |
| sodium dodecyl benzene sulfonate | 13.28 |
| urea | 20.36 |
| water | 33.00 |

viscosity = 140 cps

EXAMPLE VI

| Component | Parts by Weight |
|---|---|
| calcium stearate | 30.01 |
| condensate of nonyl phenol + 10 moles ethylene oxide | 1.85 |
| $C_{12}$ to $C_{15}$ ethoxy sulfate, sodium salt (3 moles of ethylene oxide) | 12.68 |
| urea | 19.46 |
| water | 36.00 |

viscosity = 328 cps

EXAMPLE VII

| Component | Parts by Weight |
|---|---|
| calcium stearate | 24.85 |
| condensate of nonyl phenol + 10 moles ethylene oxide | 1.53 |
| tridecyl alcohol sulfate, sodium salt | 10.50 |
| urea | 16.12 |
| water | 47.00 |

viscosity = 44 cps

EXAMPLE VIII

| Component | Parts by Weight |
|---|---|
| calcium stearate | 30.01 |
| condensate of nonyl phenol + 10 moles ethylene oxide | 1.85 |

-continued

| Component | Parts by Weight |
|---|---|
| sulfated castor oil ethoxylated with 5 moles ethylene oxide, sodium salt | 12.68 |
| urea | 19.46 |
| water | 36.00 |

viscosity = 104 cps

EXAMPLE IX

| Component | Parts by Weight |
|---|---|
| calcium stearate | 23.45 |
| condensate of nonyl phenol + 10 moles ethylene oxide | 1.45 |
| phosphate ester of the condensate of nonyl phenol and 9 moles of ethylene oxide | 9.90 |
| ures | 15.20 |
| water | 50.00 |

viscosity = 540 cps

EXAMPLE X

| Component | Parts by Weight |
|---|---|
| calcium stearate | 30.01 |
| condensate of nonyl phenol + 10 moles ethylene oxide | 1.85 |
| sulfated nonyl phenol condensed with 4 moles of ethylene oxide, $NH_4$ salt | 12.68 |
| urea | 19.46 |
| water | 36.00 |

viscosity = 216 cps

EXAMPLE XI

| Component | Parts by Weight |
|---|---|
| calcium stearate | 27.20 |
| condensate of nonyl phenol + 10 moles ethylene oxide | 1.68 |
| R—CH=CH $CH_2SO_3$ Na, where R=$C_{11}$-$C_{13}$ (mixed) | 11.49 |
| urea | 17.63 |
| water | 42.00 |

viscosity = 120 cps

EXAMPLE XII

| Component | Parts by Weight |
|---|---|
| calcium stearate | 27.20 |
| condensate of nonyl phenol + 10 moles ethylene oxide | 1.68 |
| sulfonated octyl phenol condensed with 7 moles of ethylene oxide, sodium salt | 11.49 |
| urea | 17.63 |
| water | 42.00 |

viscosity = 70 cps

EXAMPLE XIII

| Component | Parts by Weight |
|---|---|
| calcium stearate | 30.01 |
| condensate of nonyl phenol + 10 moles ethylene oxide | 1.85 |

-continued

| Component | Parts by Weight |
|---|---|
| sodium di-octyl sulfosuccinate | 12.68 |
| urea | 19.46 |
| water | 36.00 |

viscosity = 574 cps

The above examples describe lubricants of solids content from 50% to 67% by weight solids. Since the inability to use calcium stearate dispersions of greater than 55% by weight solids is a result of the high viscosities obtained, it can be seen that these high solids lubricants have useful viscosities with enhanced solids concentration. The result is a product which is flowable, pumpable and filterable; thus providing the same ease of handling as a 55% by weight calcium stearate dispersion.

Examples XIV through XXVI describe coating compositions prepared in part using increased solids lubricant dispersions of this invention. In these examples, all parts by weight of the components which are introduced with water are reported on a solids basis. Total water present in each example is reported.

Examples XIV through XXVI were prepared according to the following general procedure.

Pre-dispersed, spray dried clay was dispersed in water at 70% by weight total solids. Oxidized starch was slurried in tap water at ambient temperature in a jacketed vessel and cooked at 190° F. for 30 minutes. The cooked starch was then blended with the clay slurry under agitation supplied by a high speed laboratory stirrer. Then carboxylated styrene-butadiene (SB) latex (50% by weight solids) and the high solids lubricant composition of this invention were added and total coating solids adjusted with tap water to 50% by weight of total.

EXAMPLE XIV

| Component | Parts by Weight |
|---|---|
| clay (No. 2 coating clay) | 100.0 |
| starch (oxidized corn starch) | 16.0 |
| carboxylated SB latex (Dow 620) | 4.0 |
| lubricant solids of Example I | 1.0 |
| total water | 121.0 |

EXAMPLE XV

| Component | Parts by Weight |
|---|---|
| clay (No. 2 coating clay) | 100.0 |
| starch (oxidized corn starch) | 16.0 |
| carboxylated SB latex (Dow 620) | 4.0 |
| lubricant solids of Example II | 1.0 |
| total water | 121.0 |

EXAMPLE XVI

| Component | Parts by Weight |
|---|---|
| clay (No. 2 coating clay) | 100.0 |
| starch (oxidized corn starch) | 16.0 |
| carboxylated SB latex (Dow 620) | 4.0 |
| lubricant solids of Example III | 1.0 |
| total water | 121.0 |

EXAMPLE XVII

| Component | Parts by Weight |
|---|---|
| clay (No. 2 coating clay) | 100.0 |
| starch (oxidized corn starch) | 16.0 |
| carboxylated SB latex (Dow 620) | 4.0 |
| lubricant solids of Example IV | 1.0 |
| total water | 121.0 |

EXAMPLE XVIII

| Component | Parts by Weight |
|---|---|
| clay (No. 2 coating clay) | 100.0 |
| starch (oxidized corn starch) | 16.0 |
| carboxylated SB latex (Dow 620) | 4.0 |
| lubricant solids of Example V | 1.0 |
| total water | 121.0 |

EXAMPLE XIX

| Component | Parts by Weight |
|---|---|
| clay (No. 2 coating clay) | 100.0 |
| starch (oxidized corn starch) | 16.0 |
| carboxylated SB latex (Dow 620) | 4.0 |
| lubricant solids of Example VI | 1.0 |
| total water | 121.0 |

EXAMPLE XX

| Component | Parts by Weight |
|---|---|
| clay (No. 2 coating clay) | 100.0 |
| starch (oxidized corn starch) | 16.0 |
| carboxylated SB latex (Dow 620) | 4.0 |
| lubricant solids of Example VII | 1.0 |
| total water | 121.0 |

EXAMPLE XXI

| Component | Parts by Weight |
|---|---|
| clay (No. 2 coating clay) | 100.0 |
| starch (oxidized corn starch) | 16.0 |
| carboxylated SB latex (Dow 620) | 4.0 |
| lubricant solids of Example VIII | 1.0 |
| total water | 121.0 |

EXAMPLE XXII

| Component | Parts by Weight |
|---|---|
| clay (No. 2 coating clay) | 100.0 |
| starch (oxidized corn starch) | 16.0 |
| carboxylated SB latex (Dow 620) | 4.0 |
| lubricant solids of Example IX | 1.0 |
| total water | 121.00 |

EXAMPLE XXIII

| Component | Parts by Weight |
|---|---|
| clay (No. 2 coating clay) | 100.0 |
| starch (oxidized corn starch) | 16.0 |
| carboxylated SB latex (Dow 620) | 4.0 |
| lubricant solids of Example X | 1.0 |
| total water | 121.0 |

EXAMPLE XXIV

| Component | Parts by Weight |
|---|---|
| clay (No. 2 coating clay) | 100.0 |
| starch (oxidized corn starch) | 16.0 |
| carboxylated SB latex (Dow 620) | 4.0 |
| lubricant solids of Example XI | 1.0 |
| total water | 121.0 |

EXAMPLE XXV

| Component | Parts by Weight |
|---|---|
| clay (No. 2 coating clay) | 100.0 |
| starch (oxidized corn starch) | 16.0 |
| carboxylated SB latex (Dow 620) | 4.0 |
| lubricant solids of Example XII | 1.0 |
| total water | 121.0 |

EXAMPLE XXVI

| Component | Parts by Weight |
|---|---|
| clay (No. 2 coating clay) | 100.0 |
| starch (oxidized corn starch) | 16.0 |
| carboxylated SB latex (Dow 620) | 4.0 |
| lubricant solids of Example XIII | 1.0 |
| total water | 121.0 |

Coatings upon 50 pound web-offset paper using the coating compositions of Examples XIV through XXVI were prepared by rod application using a Keegan coater. Coated sheets were supercalendered at 1,200 pounds per linear inch. The resulting coatings were evaluated according to the following tests which are described below.

| Test | Procedure |
|---|---|
| Gloss | TAPPI Method No. T 480 OS-78 |
| Brightness | Use a GE optical brightness meter according to TAPPI Method No. T 452 OS-77 |
| Wax Pick resistance | TAPPI Method No. T 459 OS-75 |
| I.G.T. Pick | Use I.G.T. printability tester according to TAPPI Method No. T 499 SU-64 |

The data are set forth in Table I below.

TABLE I

| Coating | Viscosity Brookfield at 100 RPM (cps) | Finished Wt. (lbs/ 3300 sq. ft.) | Gloss | Brightness | Wax Pick Resistance | I.G.T. Pick |
|---|---|---|---|---|---|---|
| Control* | 1178 | 64.9 | 53 | 72 | 9 | 108 |
| Ex. XIV | 1130 | 65.1 | 53 | 73 | 9 | 120 |

TABLE I-continued

| Coating | Viscosity Brookfield at 100 RPM (cps) | Finished Wt. (lbs/ 3300 sq. ft.) | Gloss | Brightness | Wax Pick Resistance | I.G.T. Pick |
|---|---|---|---|---|---|---|
| Ex. XV | 1176 | 65.0 | 53 | 72 | 9 | 108 |
| Ex. XVI | 1066 | 64.4 | 53 | 73 | 9 | 120 |
| Ex. XVII | 1056 | 64.9 | 55 | 70 | 9 | 108 |
| Ex. XVIII | 1006 | 66.2 | 54 | 70 | 9 | 120 |
| Ex. XIX | 1208 | 65.1 | 53 | 69 | 9 | 120 |
| Ex. XX | 1012 | 66.1 | 53 | 70 | 9 | 108 |
| Ex. XXI | 1086 | 64.5 | 55 | 70 | 9 | 108 |
| Ex. XXII | 1356 | 65.2 | 54 | 71 | 9 | 130 |
| Ex. XXIII | 1006 | 66.0 | 54 | 72 | 9 | 108 |
| Ex. XXIV | 1008 | 65.5 | 52 | 70 | 9 | 108 |
| Ex. XXV | 1060 | 66.4 | 52 | 72 | 9 | 108 |
| Ex. XXVI | 1096 | 64.2 | 53 | 72 | 9 | 108 |

*Calcium stearate solids substituted for the solids content of the lubricant of this invention.

From the data of Table I, it is concluded that substituting the high solid lubricants for calcium stearate solids of a typical coating composition results in no harmful effects on the properties of the coated sheet.

While the invention has been described with reference to certain specific embodiments thereof, it is understood that it is not to be so limited since alterations and changes may be made therein which are within the full intended scope of the appended claims.

What is claimed is:

1. High solids dispersions in water having from about 50% by weight to about 75% by weight solids and from about 25% by weight to about 50% by weight water, the solids content comprising:

| Component | Parts by Weight |
|---|---|
| calcium stearate | 1.00 |
| at least one calcium stearate dispersing agent | about 0.01 to about 0.10 |
| at least one water soluble anionic lubricant | about 0.05 to about 5.00 |
| urea | about 0.01 to about 1.00 |

said anionic lubricant being at least one of the group consisting of water soluble ammonium, substituted ammonium and alkali metal salts of:

(a) sulfated fatty acid esters
(b) fatty acid soaps
(c) sulfated fatty acids
(d) linear alkyl aryl sulfonates
(e) ethoxy sulfates
(f) alcohol sulfates
(g) sulfated castor oil ethoxylates
(h) phosphate esters of alkyl phenol ethoxylates
(i) sulfated alkyl aryl ethoxylates
(j) alpha olefin sulfonates
(k) sulfonated alkyl phenol ethoxylates
(l) bis alkyl sulfosuccinates, and
(m) sulfated glycerides of unsaturated fatty acids.

2. The dispersions of claim 1 wherein said solids content is from about 55% by weight to about 75% by weight and said water content is from about 25% by weight to about 45% by weight.

3. The dispersions of claim 2 wherein said anionic lubricant is at least one sulfated fatty acid ester.

4. The dispersions of claim 3 wherein said anionic lubricant is sulfated butyl oleate.

5. The dispersions of claim 2 wherein said anionic lubricant is at least one sulfated glyceride.

6. The dispersions of claim 5 wherein said anionic lubricant is sulfated castor oil.

7. The dispersions of claim 2 wherein said anionic lubricant is sulfated oleic acid.

8. The dispersions of claim 2 wherein said anionic lubricant is dodecyl benzene sulfonate.

9. The dispersions of claim 2 wherein said anionic lubricant is sulfated castor oil ethoxylated with about 5 moles ethylene oxide.

10. The dispersions of claim 2 wherein said anionic lubricant is sulfonated octyl phenol ethoxylated with about 7 moles ethylene oxide.

11. The dispersions of claim 2 wherein said anionic lubricant is di-octyl sulfosuccinate.

12. The dispersions of claim 2 wherein said anionic lubricant is tridecyl alcohol sulfate.

13. The dispersions of claim 2 wherein said anionic lubricant is phosphate ester of nonyl phenol ethoxylated with about 9 moles ethylene oxide.

14. Paper and paperboard coating compositions containing water, pigment, binder and the solids of the composition of claim 1.

15. Paper and paperboard coating compositions containing water, pigment, binder and the solids of the composition of claim 2.

16. Paper and paperboard coating compositions containing water, pigment, binder and the solids of the compositions of claim 3.

17. Paper and paperboard coating compositions containing water, pigment, binder and the solids of the composition of claim 4.

18. Paper and paperboard coating compositions containing water, pigment, binder and the solids of the composition of claim 5.

19. Paper and paperboard coating compositions containing water, pigment, binder and the solids of the composition of claim 6.

20. Paper and paperboard coating compositions containing water, pigment, binder and the solids of the composition of claim 7.

21. Paper and paperboard coating compositions containing water, pigment, binder and the solids of the composition of claim 8.

22. Paper and paperboard coating compositions containing water, pigment, binder and the solids of the composition of claim 9.

23. Paper and paperboard coating compositions containing water, pigment, binder and the solids of the composition of claim 10.

24. Paper and paperboard coating compositions containing water, pigment, binder and the solids of the composition of claim 11.

25. Paper and paperboard coating compositions containing water, pigment, binder and the solids of the composition of claim 12.

26. Paper and paperboard coating compositions containing water, pigment, binder and the solids of the composition of claim 13.

27. Paper and paperboard coated with the coating composition of claim 14.

28. Paper and paperboard coated with the coating composition of claim 15.

29. Paper and paperboard coated with the coating composition of claim 16.

30. Paper and paperboard coated with the coating composition of claim 17.

31. The dispersions of claim 2 wherein said anionic lubricant is the ammonium salt of sulfated nonyl phenol condensed with 4 moles of ethylene oxide.

32. The dispersions of claim 2 wherein said anionic lubricant is $R—CH{=}CHCH_2SO_3Na$, where $R=C_{11}-C_{13}$ (mixed.).

* * * * *